US008882533B2

(12) United States Patent
Brandberg et al.

(10) Patent No.: US 8,882,533 B2
(45) Date of Patent: Nov. 11, 2014

(54) ELECTRICAL CONNECTOR HAVING POKE-IN WIRE CONTACT

(75) Inventors: Philip Clay Brandberg, Carlisle, PA (US); Edward J. Howard, Millersburg, PA (US); Ivan P. Morgan, Lewisberry, PA (US); Timothy Lee Kocher, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/481,380

(22) Filed: May 25, 2012

(65) Prior Publication Data

US 2013/0316563 A1 Nov. 28, 2013

(51) Int. Cl.
*H01R 11/20* (2006.01)

(52) U.S. Cl.
USPC ..... 439/441; 439/835

(58) Field of Classification Search
USPC ..... 439/441, 268, 835
See application file for complete search history.

(56) References Cited

U.S. PATENT DOCUMENTS

| | | | | |
|---|---|---|---|---|
| 2,459,692 | A | 1/1949 | Fletcher | |
| 3,363,224 | A | 1/1968 | Gluntz | |
| 3,538,490 | A | 11/1970 | Juggins | |
| 4,299,436 | A | 11/1981 | Ackerman | |
| 4,342,495 | A | 8/1982 | Bennett et al. | |
| 4,767,686 | A | 8/1988 | Frawley | |
| 4,907,990 | A | 3/1990 | Bertho et al. | |
| 5,083,947 | A * | 1/1992 | Dominique et al. | 439/725 |
| 5,102,346 | A * | 4/1992 | Soes | 439/268 |
| 5,320,558 | A | 6/1994 | von Roretz | |
| 5,324,213 | A | 6/1994 | Frantz | |
| 6,007,369 | A | 12/1999 | Kennedy et al. | |
| 6,244,904 | B1 | 6/2001 | Fabian et al. | |
| 6,409,553 | B1 | 6/2002 | Krause et al. | |
| 6,443,749 | B2 | 9/2002 | Brownell et al. | |
| 7,004,781 | B2 * | 2/2006 | Walter | 439/441 |
| 7,175,469 | B1 * | 2/2007 | Daily et al. | 439/441 |

(Continued)

FOREIGN PATENT DOCUMENTS

| | | | |
|---|---|---|---|
| DE | 3743410 | A1 | 6/1989 |
| DE | 4102784 | A | 8/1992 |

(Continued)

OTHER PUBLICATIONS

International Search Report, International Application No. PCT/US2012/047271, International Filing Date Jul. 19, 2012.

(Continued)

*Primary Examiner* — Hien Vu

(57) ABSTRACT

An electrical connector includes a housing having a receptacle that is configured to receive an electrical wire therein along an insertion axis. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The contact beam is configured to be slidably engaged by an actuator along an actuation direction that is non-perpendicular to the insertion axis to move the contact beam from the closed position to the open position.

18 Claims, 11 Drawing Sheets

(56) References Cited

U.S. PATENT DOCUMENTS

| | | | | |
|---|---|---|---|---|
| 7,431,603 | B1 * | 10/2008 | Szmidt | 439/289 |
| 7,513,793 | B2 | 4/2009 | Horst et al. | |
| 8,113,858 | B1 * | 2/2012 | Chiang | 439/188 |
| 8,251,738 | B2 * | 8/2012 | Heckert et al. | 439/441 |
| 2010/0203752 | A1 | 8/2010 | Urano | |
| 2010/0267292 | A1 | 10/2010 | Pueschner et al. | |
| 2011/0250775 | A1 | 10/2011 | Bies et al. | |
| 2011/0250803 | A1 | 10/2011 | Bies | |
| 2011/0312228 | A1 | 12/2011 | Schrader | |

FOREIGN PATENT DOCUMENTS

| | | | |
|---|---|---|---|
| DE | 19735835 | A1 | 2/1999 |
| DE | 19735835 | B4 | 12/2004 |
| DE | 20 2006 000380 | U1 | 2/2007 |
| DE | 10 2005 048972 | A1 | 4/2007 |
| DE | 10 2008 039232 | A1 | 2/2010 |
| EP | 458410 | A | 11/1991 |
| EP | 0 675 568 | A1 | 10/1995 |
| EP | 2375503 | A2 | 10/2011 |
| JP | 06068914 | A | 3/1994 |
| JP | 08306426 | A | 11/1996 |
| WO | WO2010/079130 | | 7/2010 |
| WO | 2010 146525 | A1 | 12/2010 |

OTHER PUBLICATIONS

International Search Report, International Application No. PCT/US2013/039235, International Filing Date Feb. 5, 2013.

AVX Corporation, Series 9276, "Discrete Wire-to-Board; Poke-Home", <http://www.avx.com/docs/catalogs/9276.pdf>.

* cited by examiner

ELECTRICAL CONNECTOR HAVING POKE-IN WIRE CONTACT

BACKGROUND OF THE INVENTION

The subject matter described herein relates generally to an electrical connector having a poke-in wire contact.

Some electrical connectors terminate electrical wires. Such electrical connectors include an electrical contact that engages an electrical wire to establish an electrical connection therebetween. The electrical contacts of some electrical connectors that terminate electrical wires are poke-in wire contacts. Poke-in wire contacts include wire interfaces that extend within a receptacle of the electrical connector. The electrical wire is inserted, or poked, into the receptacle such that the electrical wire engages, and thereby forms an electrical connection with, the wire interface of the poke-in wire contact.

Poke-in wire contacts are not without their disadvantages. For example, because the wire interface engages the wire, it may be difficult to remove the electrical wire from the receptacle without damaging the electrical wire and/or the poke-in contact. Damage to the electrical wire and/or the poke-in contact may require repair and/or replacement thereof, which may increase a cost of the electrical connector.

SUMMARY OF THE INVENTION

In one embodiment, an electrical connector includes a housing having a receptacle that is configured to receive an electrical wire therein along an insertion axis. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The contact beam is configured to be slidably engaged by an actuator along an actuation direction that is non-perpendicular to the insertion axis to move the contact beam from the closed position to the open position.

In another embodiment, an electrical connector includes a housing having a receptacle that is configured to receive an electrical wire therein along an insertion axis. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The electrical connector includes an actuator that is configured to slidably engage the contact beam along an actuation direction that is non-perpendicular to the insertion axis to move the contact beam from the closed position to the open position.

In another embodiment, an electrical connector includes a housing having a receptacle that is configured to receive an electrical wire therein along an insertion axis. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The contact beam is configured to be slidably engaged by an actuator along an actuation direction that is approximately parallel to the insertion axis to move the contact beam from the closed position to the open position.

DETAILED DESCRIPTION OF THE DRAWINGS

Figure 1:
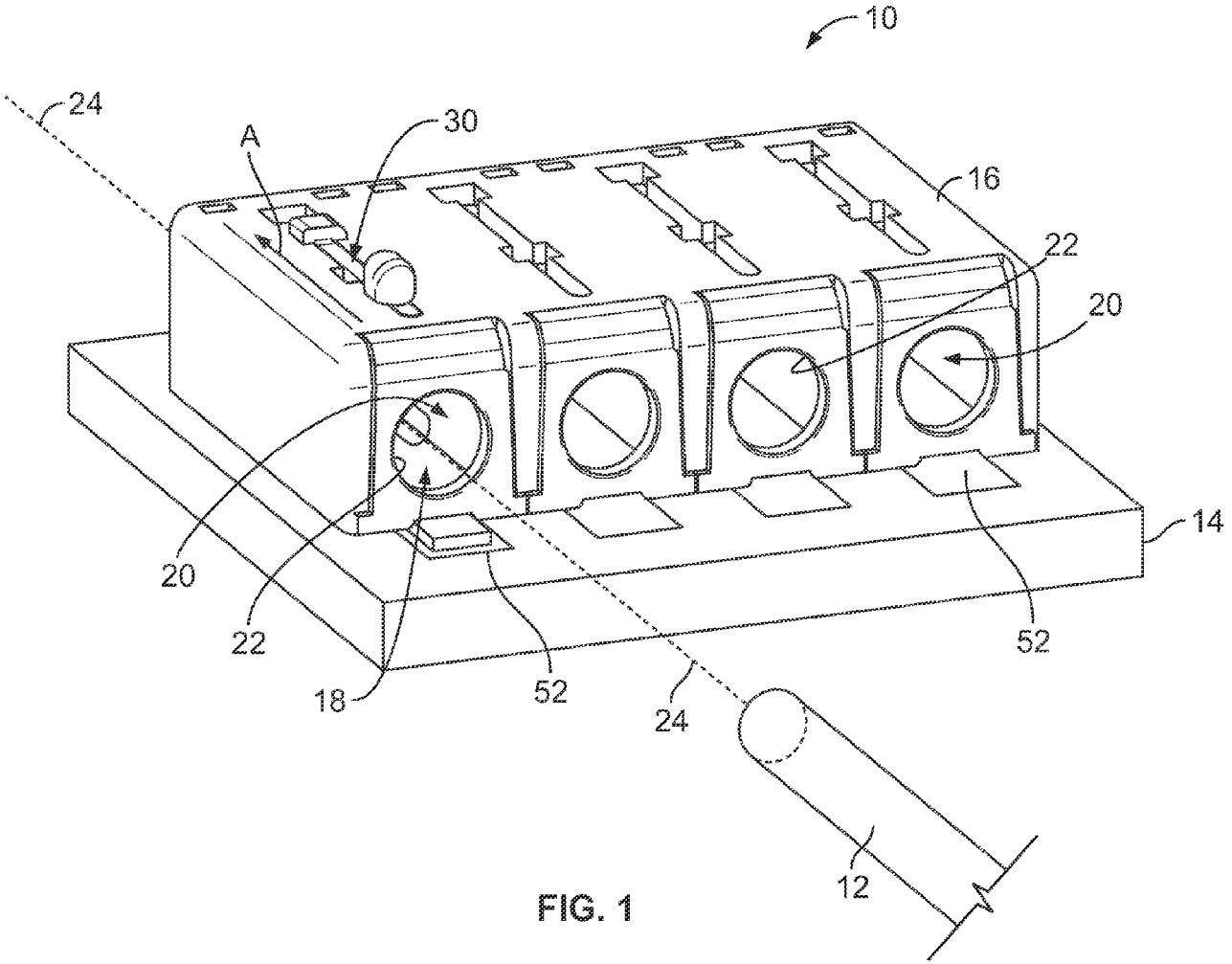
FIG. 1 is a perspective view of an exemplary embodiment of an electrical connector.

FIG. 1 is a perspective view of an exemplary embodiment of an electrical connector 10. The electrical connector 10 is configured to electrically connect to one or more electrical wires 12. The electrical wires 12 may or may not be grouped together in a cable (not shown). In the exemplary embodiment, the electrical connector 10 is mounted on a substrate 14 for providing an electrical path between the electrical wires 12 and the substrate 14. In other embodiments, the electrical connector 10 terminates one or more other electrical wires (not shown) for providing an electrical path between the electrical wires 12 and the other electrical wires. The other electrical wires may or may not be grouped together in a cable (not shown). The substrate 14 may be any type of substrate, such as, but not limited to, a circuit board and/or the like.

The electrical connector 10 includes a housing 16 and one or more electrical contacts 18. The electrical contacts 18 are poke-in contacts. For example, the housing 16 includes one or more receptacles 20. The electrical contacts 18 are held within the receptacles 20. Each receptacle 20 is configured to receive a corresponding electrical wire 12 therein. Specifically, the receptacles 20 include entrances 22 through which electrical wires 12 are inserted. In other words, the electrical wires 12 are inserted, or poked, into the receptacles 20 through the entrances 22. Each receptacle 20 receives the corresponding electrical wire 12 therein along an insertion axis 24. Once the electrical wires 12 are poked into the receptacles 20, each electrical wire 12 engages, and thereby electrically connects to, the corresponding electrical contact 18 to establish an electrical connection between the electrical connector 10 and the electrical wire 12.

As will be described below, the electrical contacts 18 include contact beams 26 (FIGS. 2, 3, 5, and 7-10) that have wire interfaces 48 (FIGS. 2, 3, and 7-10). The contact beams 26 are movable between open and closed positions. In the closed position, the wire interface 48 is configured to engage the corresponding electrical wire 12. In the open position, the wire interface 48 is configured to be disengaged from the corresponding electrical wire 12. One or more actuators 30 is provided for moving the contact beams 26 from the closed positions to the open positions to thereby enable the electrical wires 12 to be inserted into, and removed from, the receptacles 20. As will be described in more detail below, the actuator(s) 30 is configured to slidably engage the contact beam(s) 26 along an actuation direction A that is non-perpendicular to the insertion axis 24. The electrical connector 10 may include any number of actuators 30 for slidable engagement with any number of electrical contacts 18. Only one actuator 30 is shown in FIG. 1 for clarity.

Although four are shown, the housing 16 may include any number of receptacles 20 for receiving any number of electrical wires 12. Each receptacle 20 may receive any number of electrical wires 12 therein. In the exemplary embodiment, each receptacle 20 receives a single corresponding electrical wire 12 therein. Only one electrical wire 12 is shown in FIG. 1 for clarity. The housing 16 may hold any number of electrical contacts 18. In the exemplary embodiment, the housing 16 holds four electrical contacts 18. Each receptacle 20 may hold any number of electrical contacts 18 therein. In the exemplary embodiment, each receptacle 20 holds a single corresponding electrical contact 18. Only one electrical contact 18 is shown in FIG. 1 for clarity. Each electrical contact 18 may engage, and thereby electrically connect to, any number of electrical wires 12. In the exemplary embodiment, each electrical contact 18 engages a single corresponding electrical wire 12.

Figure 2:
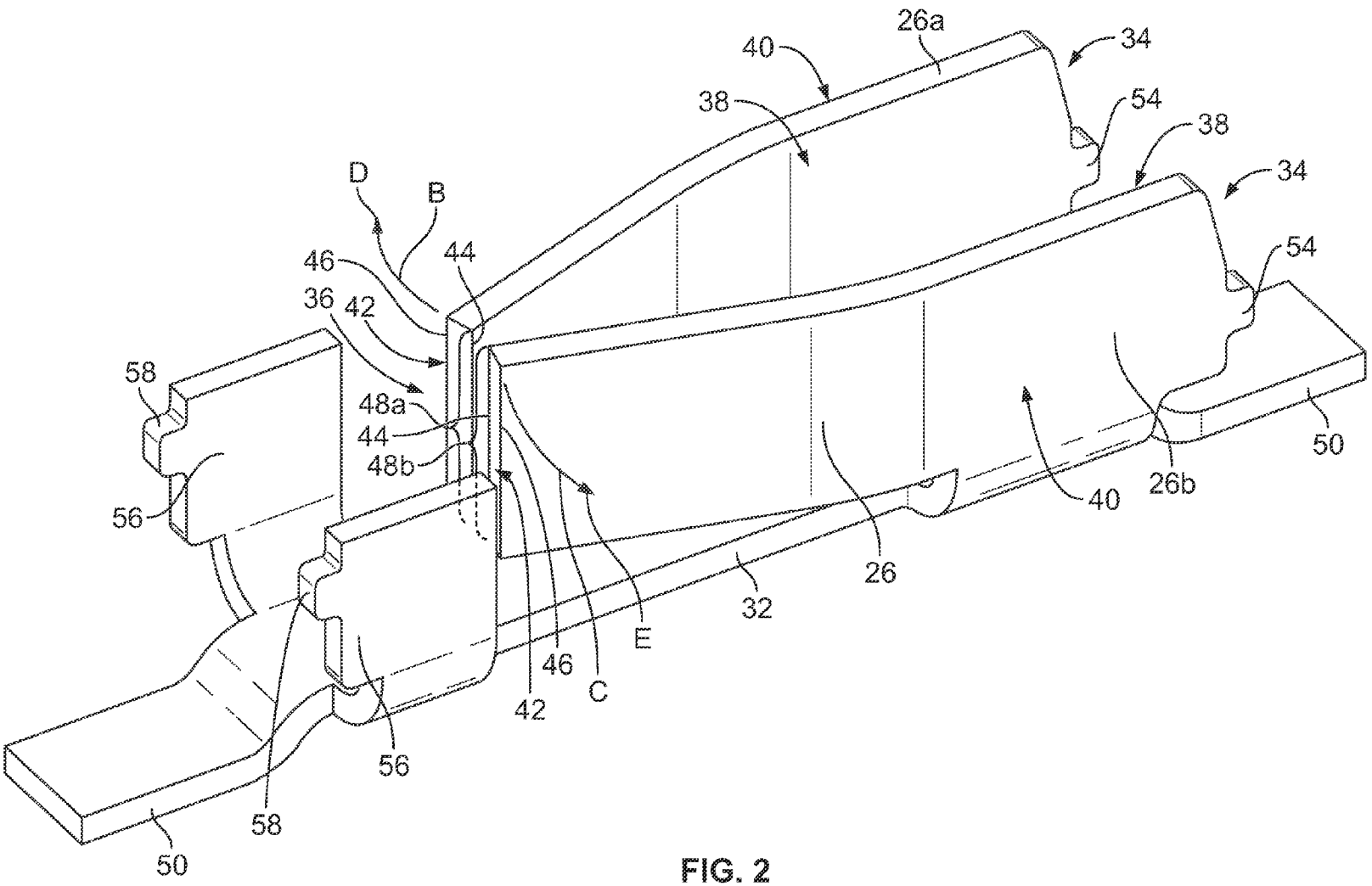
FIG. 2 is a perspective view of an exemplary embodiment of an electrical contact of the electrical connector shown in FIG. 1.
Figure 3:
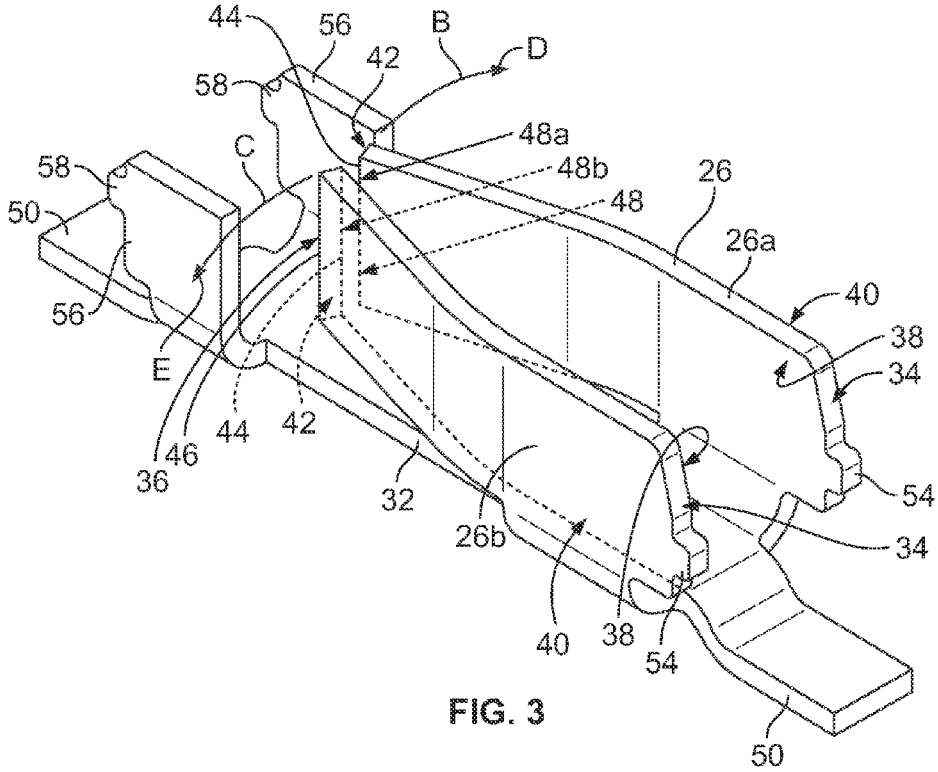
FIG. 3 is another perspective view of the electrical contact shown in FIG. 2 viewed from a different angle than FIG. 2.

FIGS. 2 and 3 are perspective view of an exemplary embodiment of the electrical contact 18. The electrical contact 18 includes a base 32 and one or more of the contact beams 26. The contact beams 26 extend from the base 32. Each contact beam 26 extends a length from an end 34 to an opposite end 36. The contact beams 26 include inner sides 38, outer sides 40 that are opposite the inner sides 38, and end sides 42. The end sides 42 intersect the inner sides 38 at edges 44. The edge 44 may be considered a portion of the inner side 38 and/or a portion of the end side 42. In other words, the inner side 38 and/or the end side 42 may be considered to include the edge 44. The end sides 42 intersect the outer sides 40 at edges 46. The end 36 of each of the contact beams 26 include the edges 44 and 46, the end side 42, a portion of the inner side 38 that extends adjacent the edge 44, and a portion of the outer side 40 that extends adjacent the edge 46.

The contact beams 26 include the wire interfaces 48 where the contact beams 26 are configured to engage the corresponding electrical wire 12 to thereby form an electrical connection between the electrical contact 18 and the corresponding electrical wire 12. For each contact beam 26, the wire interface 48 may or may not press into the corresponding electrical wire 12 when wire interface 48 is engaged with the corresponding electrical wire 12. In the exemplary embodiment, the wire interface 48 of each contact beam 26 is at least partially defined by the edge 44. In other words, in the exemplary embodiment, the wire interface 48 includes the edge 44. A portion of the end side 42 that is adjacent the edge 44 and/or a portion of the inner side 38 that is adjacent the edge 44 may also engage the corresponding electrical wire 12, for example in embodiments wherein the contact beam 26 presses into the corresponding electrical wire 12. In other words, in some embodiments, the wire interface 48 includes a portion of the end side 42 that is adjacent the edge 44 and/or a portion of the inner side 38 that is adjacent the edge 44. In addition or alternatively to the edge 44, a portion of the end side 42 that is adjacent the edge 44, and/or a portion of the inner side 38 that is adjacent the edge 44, any other location(s) along the contact beam 26 may define a portion or an entirety of the wire interface 48 of the contact beam 26.

In the exemplary embodiment, the electrical contact 18 includes two of the contact beams 26*a* and 26*b*. But, the electrical contact 18 may include any number of contact beams 26. For example, in some alternative embodiments, the electrical contact 18 includes a single contact beam 26 (e.g., the contact beam 26*a* or the contact beam 26*b*). The inner sides 38 of the contact beams 26*a* and 26*b* oppose each other. The contact beams 26*a* and 26*b* include respective wire interfaces 48*a* and 48*b* that oppose each other. In the exemplary embodiment, the corresponding electrical wire 12 is configured to be received and secured between the wire interfaces 48*a* and 48*b* of the contact beams 26*a* and 26*b*, respectively. In embodiments wherein the wire interface 48*a* and/or the wire interface 48*b* presses into the corresponding electrical wire 12, the corresponding electrical wire 12 is compressed between the wire interfaces 48*a* and 48*b* of the contact beams 26*a* and 26*b*, respectively. Each of the contact beams 26*a* and 26*b* may be referred to herein as a "first" and/or a "second" contact beam. The wire interfaces 48*a* and 48*b* may each be referred to herein as a "first" and/or a "second" wire interface.

Figure 8:
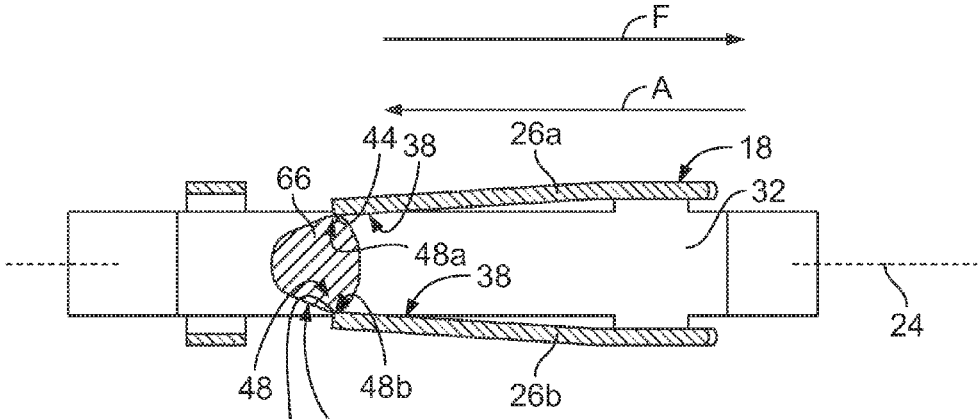
FIG. 8 is a cross-sectional view of the electrical contact shown in FIGS. 2, 3, and 7 and the actuator shown in FIGS. 4-7 illustrating the actuator in an actuated position.
Figure 10:
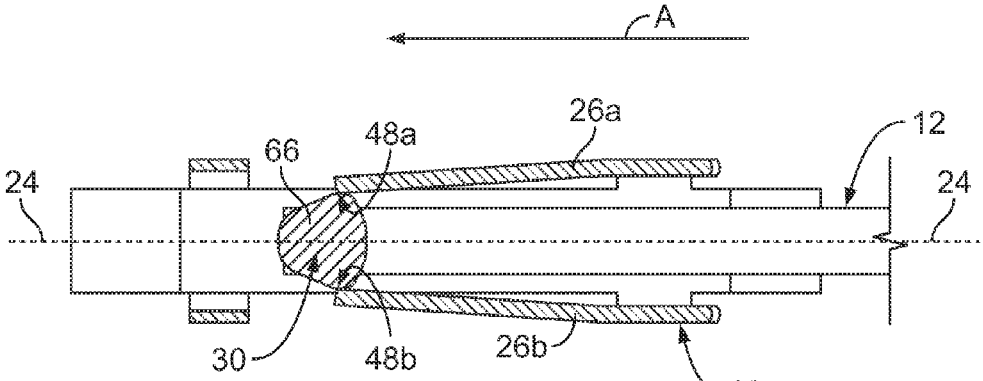
FIG. 10 is a cross-sectional view of the electrical contact shown in FIGS. 2, 3, and 7-9 illustrating an open position of the electrical contact wherein the electrical wire can be uninstalled from the electrical contact.

Each of the contact beams 26 is movable between an open position and one or more closed positions. Specifically, each contact beam 26*a* and 26*b* is moveable along a respective arc B and C between an open position and one or more closed positions. FIGS. 8 and 10 illustrate the open positions of the contact beams 26*a* and 26*b*. In the open position, the contact beam 26 is configured to be disengaged from the corresponding electrical wire 12. Specifically, the wire interface 48 of the contact beam 26 is configured to be disengaged from the corresponding electrical wire 12 when the contact beam 26 is in the open position. In at least one closed position, the contact beam 26 is configured to engage the corresponding electrical wire 12 at the wire interface 48.

Figure 9:
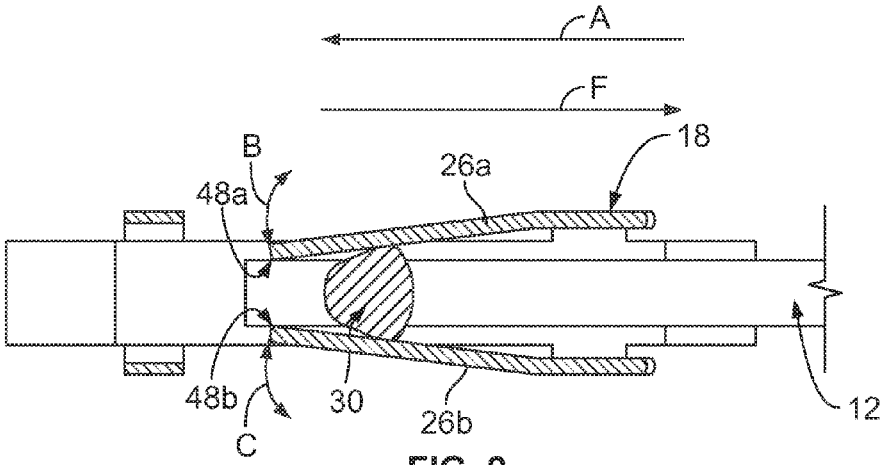
FIG. 9 is a cross-sectional view of the electrical contact shown in FIGS. 2, 3, 7, and 8 illustrating an electrical wire installed to the electrical contact.

In the exemplary embodiment, each contact beam 26 includes a fully closed position when the corresponding electrical wire 12 is not present and a partially closed position when the contact beam 26 is engaged with the corresponding electrical wire 12. The contact beams 26*a* and 26*b* are shown in the fully closed positions in FIGS. 2, 3, and 7. FIG. 9 illustrates the partially closed positions of the contact beams 26*a* and 26*b*. Each contact beam 26 is movable from the fully closed position to the partially closed position to accommodate the presence of the corresponding electrical wire 12. Each contact beam 26 is further moveable from the partially closed position to the open position. In other words, each contact beam 26 is moveable from the fully closed position to the open position. In some alternative embodiments, one or more of the contact beams 26 is configured to engage the corresponding electrical wire 12 when the contact beam 26 is in the fully closed position.

As shown in FIGS. 2 and 3, in the exemplary embodiment, the wire interfaces 48*a* and 48*b* of the respective contact beams 26*a* and 26*b* do not engage each other when the contact beams 26*a* and 26*b* are in the fully closed positions. But, alternatively the wire interfaces 48*a* and 48*b* engage each other when the contact beams 26*a* and 26*b*, respectively, are in the fully closed positions.

It should be understood that the open position of a contact beam 26 depends on the size of the corresponding electrical wire 12. For example, a position of a contact beam 26 that is open (wherein the contact beam 26 does not engage the corresponding electrical wire 12) with respect to a smaller-sized electrical wire 12 may be closed (wherein the contact beam 26 engages the corresponding electrical wire 12) with respect to a larger-sized electrical wire 12. The open position of a contact beam 26 may or may not be at the end of a range of movement of the contact beam 26. In other words, as a contact beam 26 is moved from the partially closed position to the open position, the contact beam 26 may or may not disengage from the corresponding electrical wire 12 before the contact beam 26 has reached an end of the range of movement of the contact beam 26. For example, the open position of a contact beam 26 may or may not be at the end of a range of deflection and/or an elastic range of the contact beam 26.

Optionally, one or more of the contact beams 26 is a spring that is resiliently deflectable from the fully closed position to the open position. The exemplary embodiment of each of the contact beams 26*a* and 26*b* is a spring that is resiliently deflectable from the fully closed position to the open position. In other words, the contact beams 26*a* and 26*b* are each resiliently deflectable along the respective arcs B and C in the respective directions D and E. The contact beams 26*a* and 26*b* are thus each resiliently deflectable from the fully closed position to the partially closed position, and from the partially closed position to the open position. In some alternative embodiments, the contact beam 26*a* and/or 26*b* is movable from a closed position to an open position without being resiliently deflectable from the closed position to the open position.

In the exemplary embodiment, the base 32 includes one or more surface-mount tails 50 that are configured to be surface mounted to contact pads 52 (FIG. 1) of the substrate 14 (FIG. 1), for example as is shown in FIG. 1. In addition or alternatively to the surface-mount tails 50, the base 32 and/or one or more other portions of the electrical contact 18 may include one or more other mounting structures, such as, but not limited to, a press-fit tail (not shown) that is configured to be press-fit into an electrical via (not shown) of the substrate 14, a solder tail (not shown) that is configured to be received within an opening (e.g., an electrical via) of the substrate 14, a structure that is configured to terminate an electrical wire, and/or the like. Although two are shown, the electrical contact 18 may include any number of mounting structures (e.g., any number of the surface-mount tails 50).

Figure 5:
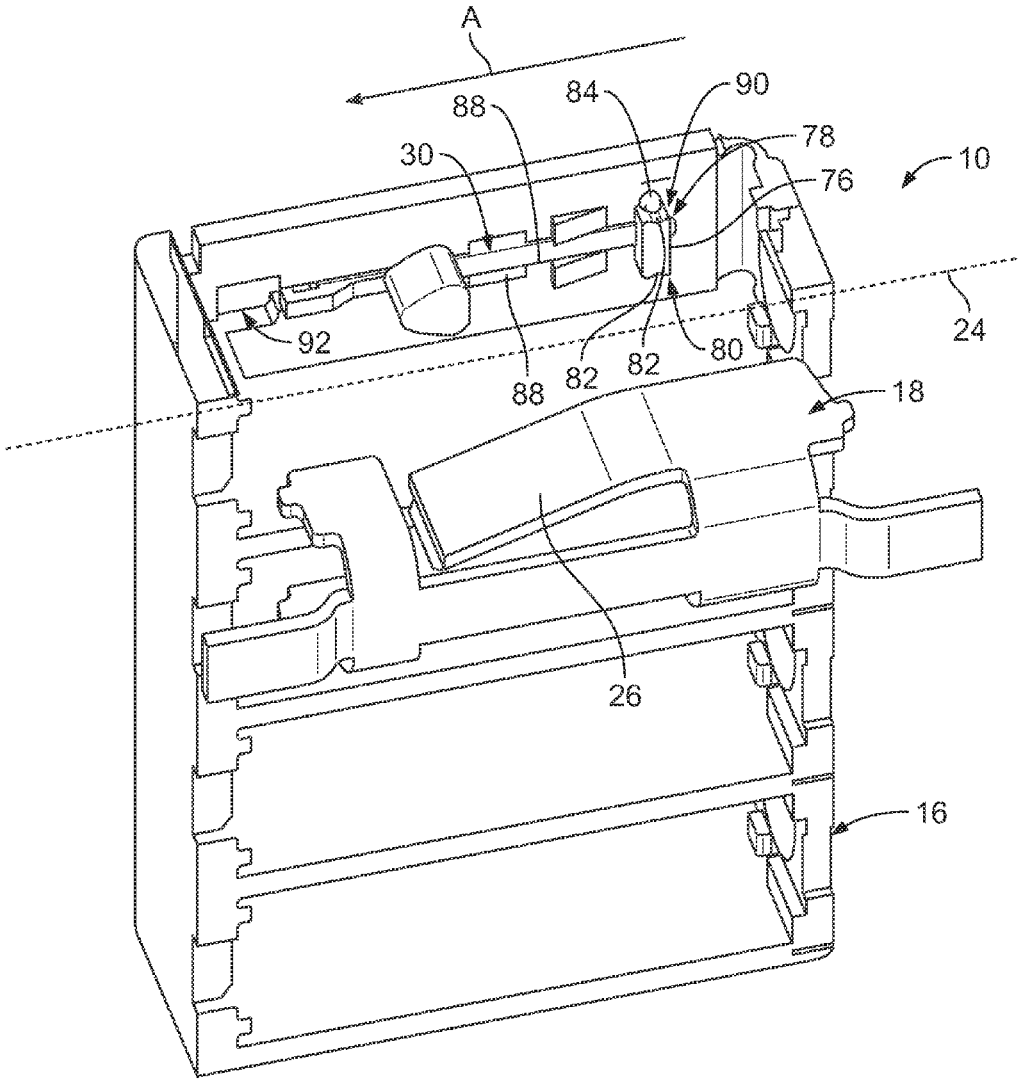
FIG. 5 is a partially exploded perspective view of the electrical connector shown in FIG. 1 illustrating the actuator shown in FIG. 4 as moveably held by an exemplary embodiment of a housing of the electrical connector.
Figure 6:
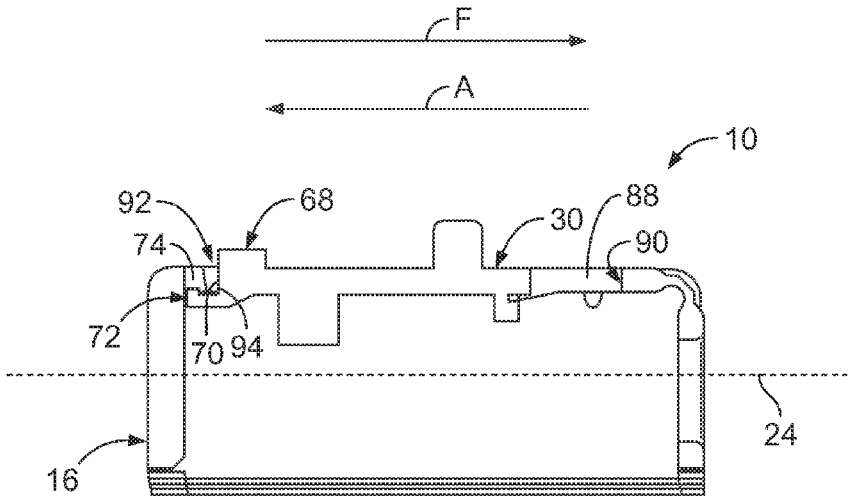
FIG. 6 is a cross-sectional view of a portion of the electrical connector shown in FIGS. 1 and 5 illustrating the actuator as moveably held by the housing.

The electrical contact 18 includes one or more retention structures that hold the electrical contact 18 within the corresponding receptacle 20 (FIG. 1) of the housing 16 (FIGS. 1, 5, and 6). In the exemplary embodiment, the ends 34 of the contact beams 26 include interference tabs 54 that are configured to engage the housing 16 with an interference fit. The electrical contact 18 also includes flanges 56 that extend from the base 32 in the exemplary embodiment. The flanges 56 includes interference tabs 58 that are configured to engage the housing 16 with an interference fit to hold the electrical contact within the corresponding receptacle 20. In addition or alternatively to the tabs 54, the flanges 56, and/or the tabs 58, the electrical contact 18 may include one or more other structures for holding the electrical contact 18 within the corresponding receptacle 20, such as, but not limited to, a snap-fit structure (not shown), an opening (not shown for staking the electrical contact 18 to the housing 16, and/or the like. Each of the tabs 54, the flanges 56, and the tabs 58 may have any other location along the electrical contact 18. The electrical contact 18 may include any number of the tabs 54, any number of the flanges 56, and any number of the tabs 58.

Figure 4:
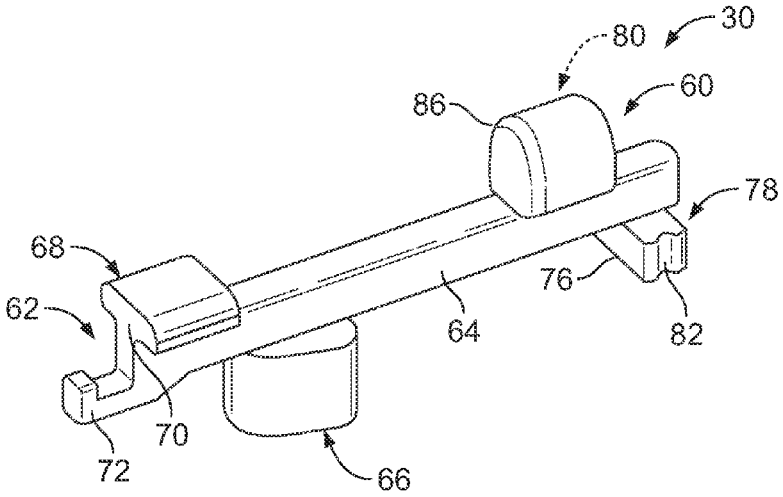
FIG. 4 is a perspective view of an exemplary embodiment of an actuator of the electrical connector shown in FIG. 1.

FIG. 4 is a perspective view of an exemplary embodiment of an actuator 30. As will be described below, the actuator 30 is configured to be movably held by the housing 16 (FIGS. 1, 5, and 6) such that the actuator 30 is configured to move relative to the housing 16. The actuator 30 extends a length from an end 60 to an opposite end 62. The actuator 30 includes a base 64. In the exemplary embodiment, the actuator 30 includes a wedge 66 that extends from the base 64. As will be described below, the wedge 66 is configured to slidably engage the contact beams 26 (FIGS. 2, 3, 5, and 7-10) of the corresponding electrical contact 18 (FIGS. 1-3, 5, and 7-10) to move the contact beams 26 from the fully closed position to the open position and thereby enable the corresponding electrical wire 12 to be installed to the corresponding electrical contact 18. The wedge 66 is also configured to slidably engage the contact beams 26 of the corresponding electrical contact 18 to move the contact beams 26 from the partially closed position to the open position and thereby enable the corresponding electrical wire 12 to be removed, or uninstalled, from the corresponding electrical contact 18. The wedge 66 is not limited to the location along the length of the actuator 30 shown herein. Rather, the wedge 66 may have any other location along the length of the actuator 30 that enables the wedge 66 to function as described and/or illustrated herein.

The actuator 30 includes a front stop 68 at the end 62. The front stop 68 includes a stop surface 70 that, as will be described below, is configured to engage the housing 16 to limit movement of the actuator 30 relative to the housing 16. Optionally, the front stop 68 includes a resiliently deflectable snap tab 72 that is configured to be received within a recess 74 (FIG. 6) of the housing 16 with a snap-fit connection.

At the end 60, the actuator 30 includes a rear retention arm 76 that extends from the base 64. The rear retention arm 76 extends a length from an end 78 to an opposite end 80 that is not visible in FIG. 4. The ends 78 and 80 include retention grooves 82 that receive corresponding extensions 84 (FIG. 5) of the housing 16 therein. Reception of the extensions 84 within the retention grooves 82 holds the actuator 30 in an unactuated position, as will be described below. The rear retention arm 76 may have any number of the retention grooves 82 for cooperating with any number of extensions 84.

Optionally, the actuator 30 includes a handle 86. The handle 86 may enable a person to move the actuator 30 relative to the housing 16, for example using a tool and/or the person's hand, fingers, thumb, palm, and/or the like. The handle 86 is not limited to the location along the length of the actuator 30 shown herein. Rather, the handle 86 may have any other location along the length of the actuator 30 that enables the handle 86 to function as described and/or illustrated herein.

FIG. 5 is a partially exploded perspective view of the electrical connector 10 illustrating the actuator 30 as moveably held by the housing 16. FIG. 6 is a cross-sectional view of a portion of the electrical connector 10 illustrating the actuator 30 as moveably held by the housing 16. The housing 16 includes a slot 88, which extends a length form an end 90 to an opposite end 92. The actuator 30 is held by the housing 16 within the slot 88. Specifically, the slot 88 moveably receives the actuator 30 therein such that the actuator 30 is configured to move along the length of the slot 88 between the ends 90 and 92. The actuator 30 moves along the length of the slot 88 between the unactuated position and an actuated position. FIG. 5 illustrates the actuator 30 in the unactuated position, while FIG. 6 illustrates the actuator 30 in the actuated position. Optionally, the actuator 30 is biased to the unactuated position, for example using a spring or other biasing mechanism.

Movement of the actuator 30 from the unactuated position toward the actuated position is along the actuation direction A. As will be described below, movement of the actuator 30 along the actuation direction A causes the actuator 30 to slidably engage the contact beams 26 (not shown in FIG. 6) of the electrical contact 18 (not shown in FIG. 6) and thereby move the contact beams 26 from the fully or partially closed positions to the open position. In the exemplary embodiment, the actuation direction A is approximately parallel to the insertion axis 24. But, the actuation direction A may be any direction that is non-perpendicular to the insertion axis 24. For example, in some embodiments, the actuation direction A is oblique to the insertion axis 24.

Referring now solely to FIG. 5, the actuator 30 is shown in the unactuated position. The extensions 84 of the housing 16 are received within the retention grooves 82 of the rear retention arm 76 of the actuator 30. Reception of the extensions 84 within the retention grooves 82 holds the actuator 30 in the unactuated position. In the exemplary embodiment, the extensions 84 are received within the retention grooves 82 with a snap-fit connection. The ends 78 and/or 80 of the rear retention arm 76 and/or the extensions 84 may be resiliently deflectable to enable the snap-fit connection between the grooves 82 and the extensions 84. The actuator 30 can be moved along the actuation direction A from the unactuated position by applying sufficient force to the actuator 30 to cause the extensions 84 to snap out of the retention grooves 82.

Referring again to FIG. 6, the actuator 30 is shown in the actuated position. The stop surface 70 of the front stop 68 of the actuator 30 is engaged with a wall 94 of the housing 16 that defines the end 92 of the slot 88. The engagement between the stop surface 70 and the wall 94 of the housing limits further movement of the actuator in the actuation direction A. The snap tab 72 of the actuator 30 is received within the recess 74 of the housing 16 to hold the actuator 30 in the actuated position. The actuator 30 can be moved along an unactuation direction F from the actuated position by applying sufficient force to the actuator 30 to cause the snap tab 72 to snap out of the recess 74.

Figure 7:
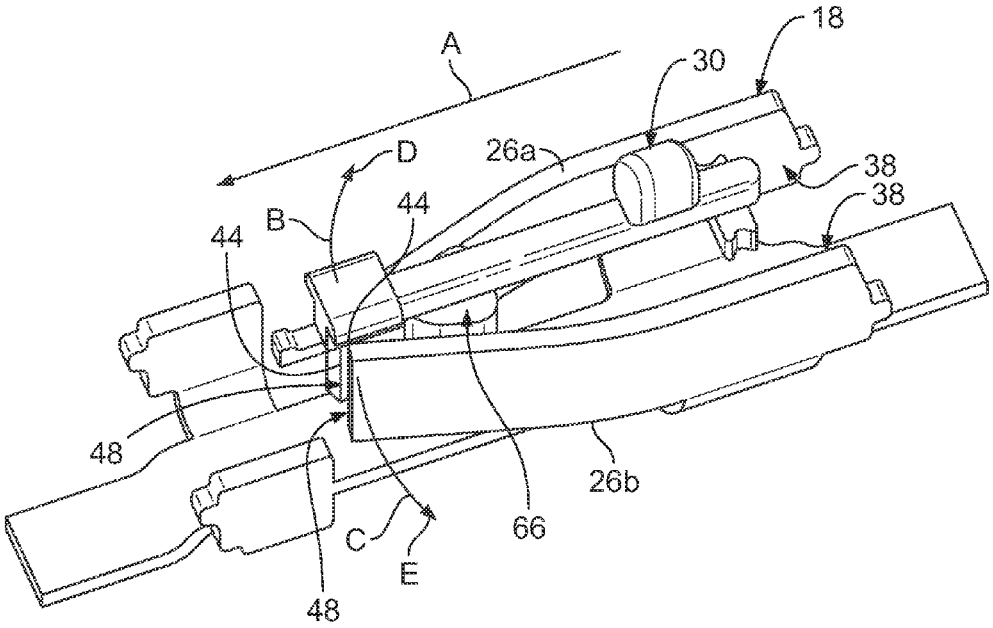
FIG. 7 is a perspective view of the electrical contact shown in FIGS. 2 and 3 and the actuator shown in FIGS. 4-6 illustrating the actuator in an unactuated position.

FIG. 7 is a perspective view of the electrical contact 18 and the actuator 30 illustrating the actuator 30 in the unactuated position. The contact beams 26*a* and 26*b* are shown in the fully closed position in FIG. 7. The actuator 30 can be moved in the actuation direction A to move the contact beams 26*a* and 26*b* from the fully closed positions to the open positions. As the actuator 30 is moved in the actuation direction A, the wedge 66 of the actuator 30 slidably engages the inner sides 38 of the contact beams 26*a* and 26*b*. The slidable engagement between the wedge 66 and the contact beams 26*a* and 26*b* moves the contact beams 26*a* and 26*b* along the respective arcs B and C in the respective directions D and E from the fully closed positions to the open positions.

FIG. 8 is a cross-sectional view of the electrical contact 18 and the actuator 30 illustrating the actuator 30 in the actuated position. The contact beams 26*a* and 26*b* are shown in the open positions in FIG. 8. The wedge 66 of the actuator 30 may or may not engage the edge 44 and/or the wire interface 48 of the contact beams 26*a* and/or 26*b* to move the contact beams 26*a* and 26*b* to the open positions. In the exemplary embodiment, and as should be apparent from a comparison of FIGS. 7 and 8, the wedge 66 of the actuator 30 slidably engages the edge 44 of each of the contact beams 26*a* and 26*b* to move the contact beams 26*a* and 26*b* to the open positions. But, in some alternative embodiments, the wedge 66 does not engage the edges 44 to move the contact beams 26*a* and 26*b* to the open positions. In other words, in some alternative embodiments, the wedge 66 does not travel far enough in the actuation direction A to engage the edges 44, but rather is disengaged from the edges 44 in the actuated position. As should be apparent from a comparison of FIGS. 7 and 8, in the exemplary embodiment, the wedge 66 of the actuator 30 slidably engages the contact beams 26*a* and 26*b* at the wire interfaces 48 to move the contact beams 26*a* and 26*b* to the open positions. But, in some alternative embodiments, the wedge 66 does not slidably engage the wire interface 48 of the contact beams 26*a* and/or 26*b* to move the contact beams 26*a* and 26*b* to the open positions.

In embodiments wherein the electrical contact 18 includes two contact beams 26, the wedge 66 of the actuator 30 is received between the contact beams 26*a* and 26*b* to spread the contact beams 26*a* and 26*b* apart. Specifically, when the actuator 30 is moved in the actuation direction A, the slidable engagement between the wedge 66 and the contact beams 26*a* and 26*b* moves the contact beams 26*a* and 26*b* to the open positions by spreading the contact beams 26*a* and 26*b* apart from each other. It should be understood that in embodiments wherein the electrical contact 18 includes a single contact beam 26, the wedge 66 of the actuator 30 may slidably engage the single contact beam 26 in a substantially similar manner to either of the contact beams 26*a* or 26*b* to move the single contact beam from a closed position to an open position.

In the open positions shown in FIG. 8, the contact beams 26*a* and 26*b* of the electrical contact 18 are positioned such that an electrical wire 12 (FIGS. 1, 9-11, 13, and 14) can be installed to the electrical contact 18. Specifically, the corresponding electrical wire 12 can be inserted, or poked, into the corresponding receptacle 20 (FIG. 1) along the insertion axis 24. As the electrical wire 12 is poked into the receptacle 20, the electrical wire 12 is received between the wire interfaces 48*a* and 48*b* of the contact beams 26*a* and 26*b*, respectively, and between the wedge 66 and the base 32 of the electrical contact 18, for example as shown in FIG. 10. The contact beams 26*a* and 26*b* can then be moved from the open positions to the partially closed positions such that the wire interfaces 48*a* and 48*b* engage the electrical wire 12 and thereby establish an electrical connection between the electrical contact 18 and the electrical wire 12.

FIG. 9 is a cross-sectional view of the electrical contact 18 illustrating an electrical wire 12 installed to the electrical contact 18. The contact beams 26*a* and 26*b* are shown in the partially closed positions in FIG. 9. The wire interfaces 48*a* and 48*b* of the contact beams 26*a* and 26*b*, respectively, are engaged with the electrical wire 12 to electrically connect the electrical contact 18 to the electrical wire 12. The actuator is shown in the unactuated position in FIG. 9.

To move the contact beams 26*a* and 26*b* from the open positions to the partially closed positions, the actuator 30 is moved along the unactuation direction F from the actuated position to the unactuated position. In the exemplary embodiment wherein the contact beams 26*a* and 26*b* are resiliently deflectable springs, movement of the actuator 30 from the actuated position to the unactuated position enables the contact beams 26*a* and 26*b* to spring back along the respective arcs B and C from the open positions to the partially closed positions. In embodiments wherein the contact beam 26*a* and/or 26*b* is not a resiliently deflectable spring, the contact beam 26*a* and/or the contact beams 26*b* may be connected to the actuator 30 such that movement of the actuator 30 in the unactuation direction F moves the contact beam 26*a* and/or 26*b* from the open position to the partially closed position.

In some alternative embodiments, the actuator 30 is not used to install the electrical wire 12 to the electrical contact 18. For example, the actuator 30 may remain in the unactuated position and the insertion force exerted by the electrical wire 12 on the contact beams 26*a* and/or 26*b* may be sufficient to move the contact beams 26*a* and/or 26*b* from the fully closed position toward the open position a sufficient amount such that the electrical wire 12 can be captured between the wire interfaces 48*a* and 48*b* without moving the actuator 30 to the actuated position.

To uninstall the electrical wire 12 from the electrical contact 18, the actuator 30 can be moved along the actuation direction A from the unactuated position shown in FIG. 9 to the actuated position shown in FIG. 10. Referring now to FIG. 10, and as described above with respect to FIG. 8, when the actuator 30 is in the actuated position the wedge 66 of the actuator 30 engages the contact beams 26*a* and 26*b* such that the contact beams 26*a* and 26*b* are in the open positions. In the open positions, the wire interfaces 48*a* and 48*b* of the contact beams 26*a* and 26*b*, respectively, are disengaged from the electrical wire 12.

The open positions of the contact beams 26*a* and 26*b* represent an open position of the electrical contact 18 wherein the electrical wire 12 can be uninstalled from the electrical contact 18. Specifically, the electrical wire 12 can be pulled along the insertion axis 24 to remove the electrical wire 12 from the electrical contact 18 and from the corresponding housing receptacle 20 (FIG. 1).

Figure 11:
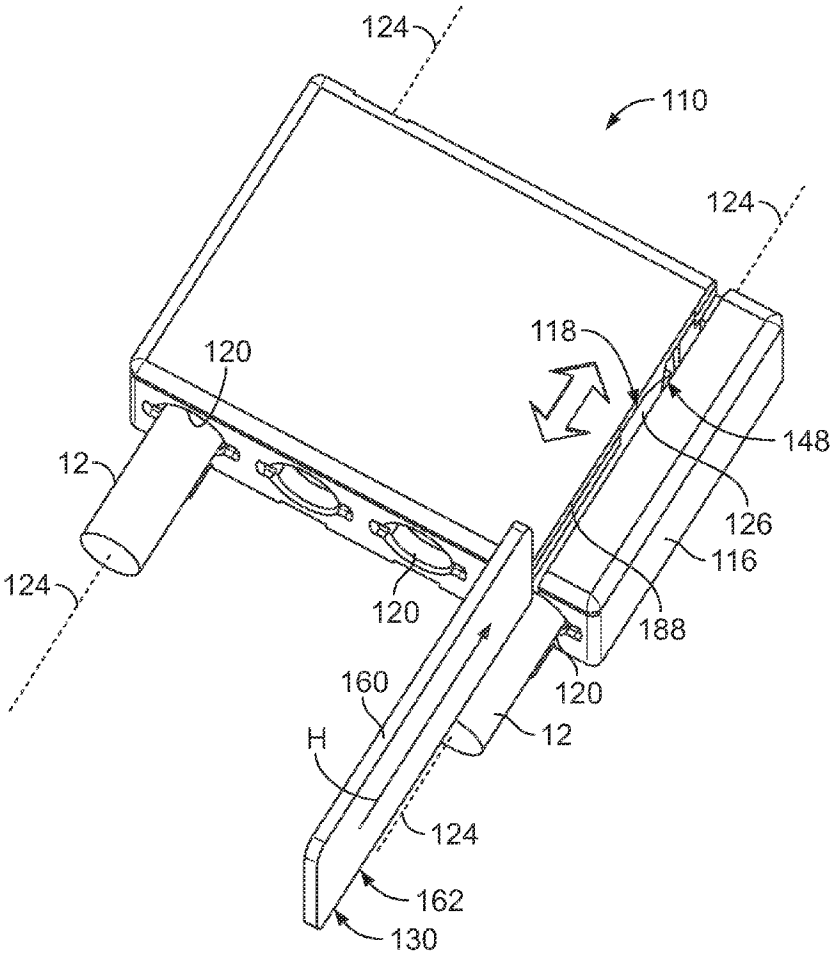
FIG. 11 is a perspective view of an exemplary alternative embodiment of an electrical connector.

FIG. 11 is a perspective view of an exemplary alternative embodiment of an electrical connector 110 that is configured to electrically connect to one or more electrical wires 12. The electrical connector 110 illustrates an embodiment wherein, instead of being held by a housing 116 of the electrical connector 110, an actuator 130 of the electrical connector 110 is separate from the housing 116.

The electrical connector 110 includes the housing 116 and one or more electrical contacts 118. The electrical contacts 118 are poke-in contacts. The housing 116 includes one or more receptacles 120 within which the electrical contacts 118 are held. Each receptacle 120 is configured to receive a corresponding electrical wire 12 therein along an insertion axis 124. Each electrical contact 118 includes one or more contact beams 126. Each contact beam 126 includes a wire interface 148 wherein the contact beam 126 is configured to engage the corresponding electrical wire 12.

The housing 116 includes a slot 188. As can be seen in FIG. 11, the slot 188 exposes the wire interfaces 148 of the contact beams 126. The slot 188 is configured to moveably receive the actuator 130 therein such that the actuator 130 moves within the slot 188 along the length of the slot 188. As will be described below, the actuator 130 is configured to slidably engage the contact beams 126 as the actuator 130 moves within the slot 188. The housing 116 may include any number of slots 188 for exposing the wire interface(s) 148 of any number of electrical contacts 118. Only one slot 188 is shown herein for clarity.

Figure 12:
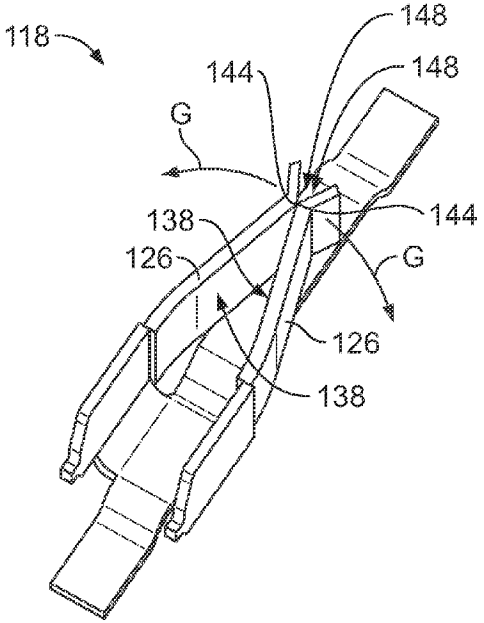
FIG. 12 is a perspective view of an exemplary embodiment of an electrical contact of the electrical connector shown in FIG. 11.

FIG. 12 is a perspective view of an exemplary embodiment of the electrical contact 118. In the exemplary embodiment, the electrical contact 118 includes two contact beams 126. The contact beams 126 include inner sides 138 that oppose each other. Each contact beam 126 includes a bend that defines an edge 144 that extends along the inner side 138.

The contact beams 126 include the wire interfaces 148 where the contact beams 126 are configured to engage the corresponding electrical wire 12 to thereby form an electrical connection between the electrical contact 118 and the corresponding electrical wire 12. In the exemplary embodiment, the wire interface 148 of each contact beam 126 is at least partially defined by the edge 144. In some embodiments, the wire interface 148 includes one or more portions of the inner side 138 that is adjacent the edge 144. In addition or alternatively to the edge 144 and/or one or more portions of the inner side 138 that is adjacent the edge 144, any other location(s) along the contact beam 126 may define a portion or an entirety of the wire interface 148 of the contact beam 126. Each of the contact beams 126 may be referred to herein as a "first" and/or a "second" contact beam. The wire interface 148 of each of the contact beams 126 may be referred to herein as a "first" and/or a "second" wire interface.

Figure 13:
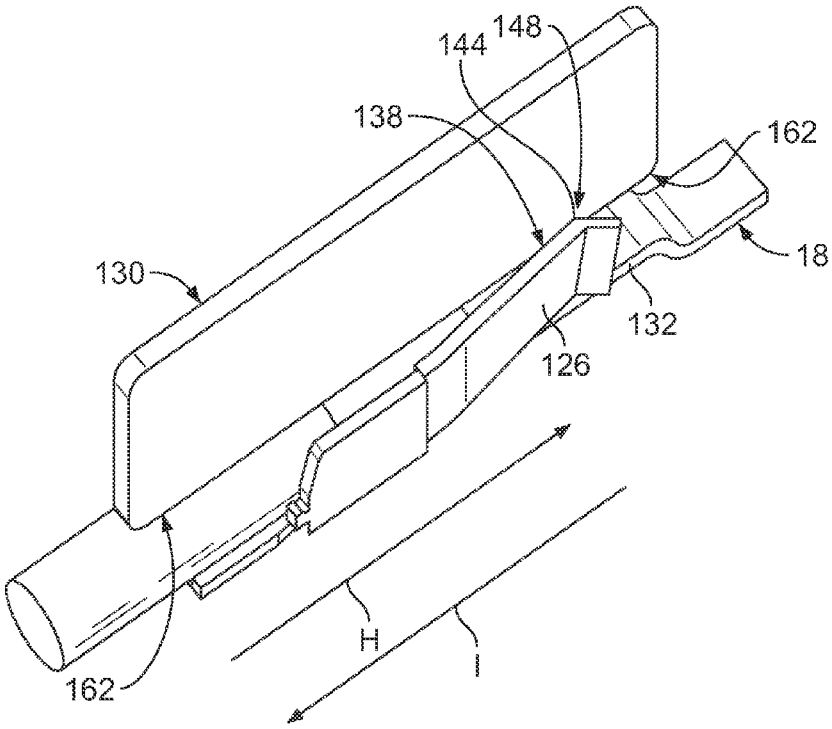
FIG. 13 is a perspective view of the electrical contact shown in FIGS. 11 and 12 and the actuator shown in FIG. 11.

Each contact beam 126 is moveable along an arc G between an open position and one or more closed positions. In the exemplary embodiment, each contact beam 126 is moveable between the open position, a partially closed position, and a fully closed position. FIGS. 11 and 12 illustrate the fully closed positions of the contact beams 126, while FIG. 13 illustrates the open positions of the contact beams 126. In the open position, each contact beam 126 is configured to be disengaged from the corresponding electrical wire 12. Specifically, the wire interface 148 of the contact beam 126 is configured to be disengaged from the corresponding electrical wire 12 when the contact beam 126 is in the open position. In the partially closed position, the wire interface 148 of each contact beam 126 is configured to be engaged with the corresponding electrical wire 12. In the exemplary embodiment, each contact beam 126 includes the fully closed position wherein the corresponding electrical wire 12 is not present. Optionally, one or more of the contact beams 126 is a spring that is resiliently deflectable from the fully closed position to the open position. In such embodiments, wherein a contact beam 126 is a spring, the contact beam 126 is resiliently deflectable from the fully closed position to the partially closed position, and from the partially closed position to the open position.

Referring again to FIG. 11, the actuator 130 extends from an end 160 to an opposite end 162. The end 162 of the actuator 130 is configured to be movably received within the slot 188 of the housing 116 such that the end 162 is configured to move within the slot 188 along the length of the slot 188. As the end 162 of the actuator 130 moves along the length of the slot 188, the end 162 is configured to slidably engage the contact beams 126 of the electrical contact 118 to move the contact beams 126 from the fully closed position to the open position and thereby enable the corresponding electrical wire 12 to be installed to the electrical contact 118. Moreover, the end 162 of the actuator 130 is also configured to slidably engage the contact beams 126 of the electrical contact 118 to move the contact beams 126 from the partially closed position to the open position and thereby enable the corresponding electrical wire 12 to be removed, or uninstalled, from the electrical contact 118.

Movement of the actuator 130 within the slot 188 to move the contact beams 126 is along an actuation direction H. Specifically, movement of the actuator 130 within the slot 188 along the actuation direction H causes the actuator 130 to slidably engage the contact beams 126 and thereby move the contact beams 126. In the exemplary embodiment, the actuation direction H is approximately parallel to the insertion axis 124. But, the actuation direction H may be any direction that is non-perpendicular to the insertion axis 124. For example, in some embodiments, the actuation direction H is oblique to the insertion axis 124.

In the exemplary embodiment, the actuator 130 is a card, such as, but not limited to, a credit card, an identification card, a driver's license, a debit card, an access (e.g., key) card, a gift card, a card specifically designed as the actuator 130, a card having a similar size and/or shape to any of the exemplary cards described and/or illustrated herein, and/or the like. But, the actuator 130 is not limited to being a card. Rather, the actuator 130 may have any structure that enables the actuator 130 to slidably engage a contact beam 126 and thereby move the contact beam 126, such as, but not limited to, a paper clip, a rod, a wire, and/or the like. The size and/or shape of the slot 188 may be selected to complement the size and/or shape of the actuator 130, and/or vice versa.

FIG. 13 is a perspective view of the electrical contact 118 and the actuator 130. The contact beams 126 are shown in the open position in FIG. 13. The actuator 130 can be moved within the slot 188 (FIG. 11) in the actuation direction H to move the contact beams 126 from the fully closed positions shown in FIGS. 11 and 12 to the open positions shown in FIG. 13. As the actuator 130 is moved in the actuation direction H, the end 162 of the actuator 130 slidably engages the inner sides 138 of the contact beams 126. The slidable engagement between the end 162 and the contact beams 126 moves the contact beams 126 from the fully closed positions to the open positions.

The end 162 of the actuator 130 may or may not engage the edge 144 and/or the wire interface 148 of each of the contact beams 126 to move the contact beams 126 to the open positions. In the exemplary embodiment, the end 162 of the actuator 130 slidably engages both the edge 144 and the wire interface 148 of each of the contact beams 126 to move the contact beams 126 to the open positions.

In the open positions shown in FIG. 13, the contact beams 126 of the electrical contact 118 are positioned such that an electrical wire 12 can be installed to the electrical contact 118. Specifically, the corresponding electrical wire 12 can be inserted, or poked, into the corresponding receptacle 120 (FIG. 11) along the insertion axis 124 (FIG. 11). As the electrical wire 12 is poked into the receptacle 120, the electrical wire 112 is received between the wire interfaces 148 of the contact beams 126 and between the end 162 of the actuator 130 and a base 132 of the electrical contact 118. The contact beams 126 can then be moved from the open positions to the partially closed positions such that the wire interfaces 148 engage the electrical wire 12 and thereby establish an electrical connection between the electrical contact 118 and the electrical wire 12. To move the contact beams 126 from the open positions to the partially closed positions, the actuator 130 is either moved along an unactuation direction I or moved further along the actuation direction H until the end 162 clears the edge 144.

In some alternative embodiments, the actuator 130 is not used to install the electrical wire 12 to the electrical contact 118. For example, the insertion force exerted by the electrical wire 12 on the contact beams 126 may be sufficient to move the contact beams 126 from the fully closed position toward the open position a sufficient amount such that the electrical wire 12 can be captured between the wire interfaces 148 without using the actuator 130.

To uninstall the electrical wire 12 from the electrical contact 118, the actuator 130 can be moved within the slot 188 along the actuation direction H to the position shown in FIG. 13, wherein the contact beams 126 are in the open positions. In the open positions, the wire interfaces 148 of the contact beams 126 are disengaged from the electrical wire 12. The electrical wire 12 can then be pulled along the insertion axis 124 to remove the electrical wire 12 from the electrical contact 118 and from the corresponding housing receptacle 120.

Figure 14:
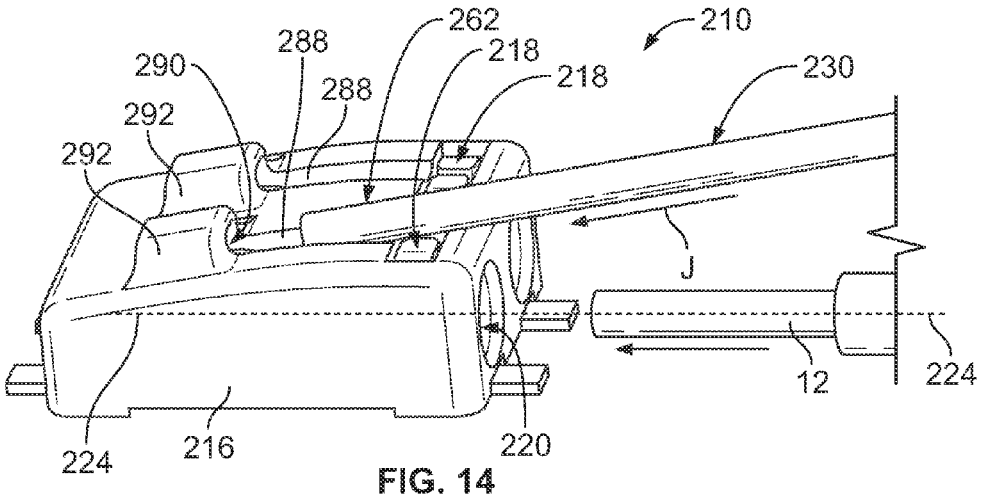
FIG. 14 is a perspective view of an exemplary alternative embodiment of an electrical connector.

FIG. 14 is a perspective view of an exemplary alternative embodiment of an electrical connector 210 that is configured to electrically connect to one or more electrical wires 12. The electrical connector 210 illustrates another embodiment wherein, instead of being held by a housing 216 of the electrical connector 210, an actuator 230 of the electrical connector 210 is separate from the housing 216.

Figure 15:
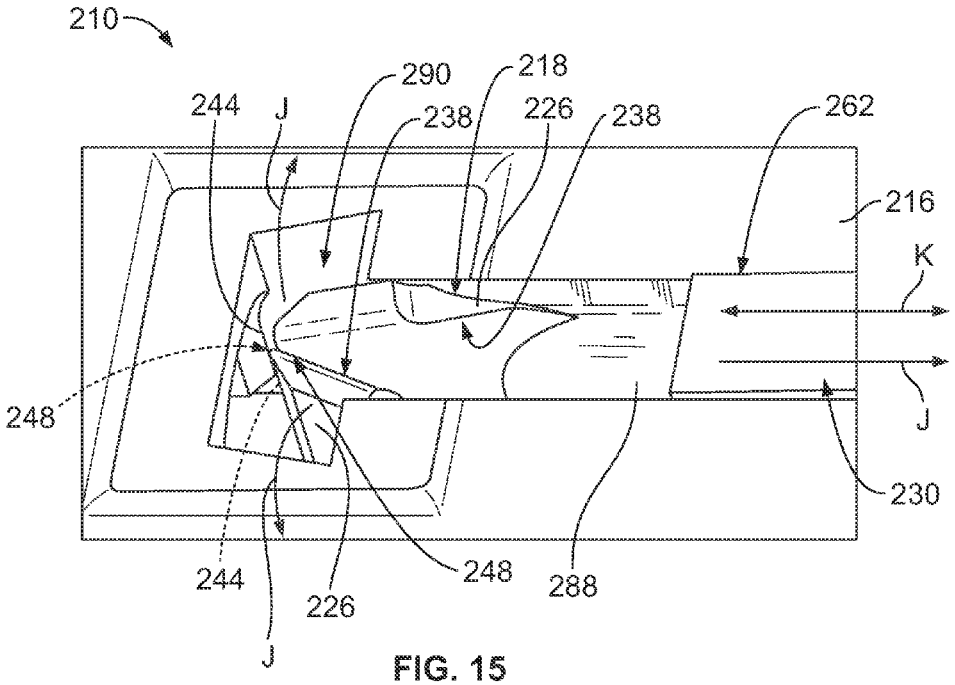
FIG. 15 is a cross-sectional view of a portion of the electrical connector shown in FIG. 14 illustrating an exemplary embodiment of a slot of the electrical connector.
Figure 16:
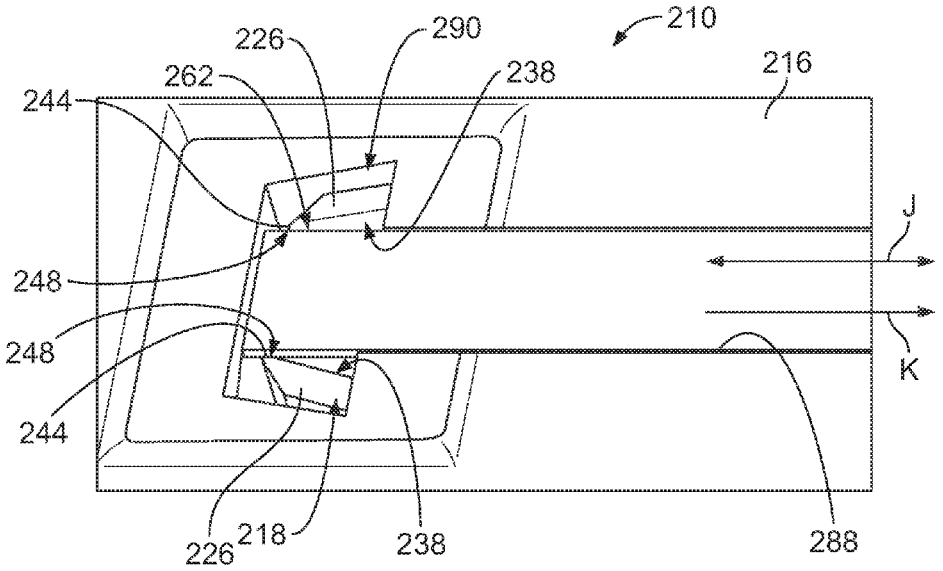
FIG. 16 is a cross-sectional view of a portion of the electrical connector shown in FIGS. 14 and 15 illustrating an open position of an exemplary embodiment of an electrical contact of the electrical connector.

The electrical connector 210 includes the housing 216 and one or more electrical contacts 218. The electrical contacts 218 are poke-in contacts. The housing 216 includes one or more receptacles 220 within which the electrical contacts 218 are held. Each receptacle 220 is configured to receive a corresponding electrical wire 12 therein along an insertion axis 224. Each electrical contact 218 includes one or more contact beams 226 (FIGS. 15 and 16). The contact beams 226 include wire interfaces 248 (FIGS. 15 and 16) wherein the contact beams 226 are configured to engage the corresponding electrical wire 12.

The housing 216 includes a slot 288. The slot extends a length to an end 290. Although not visible in FIG. 14, as can be seen in FIGS. 15 and 16, the end 290 of the slot 288 exposes the wire interfaces 248 of the contact beams 226. The slot 288 is configured to moveably receive the actuator 230 therein such that the actuator 230 moves within the slot 288 along the length of the slot 288. The actuator 230 is configured to slidably engage the contact beams 226 as the actuator 230 moves within the slot 288. Optionally, the housing 216 includes a hood 292 that extends over the end 290 of the slot 288. The hood 292 facilitates shielding the exposed wire interfaces 248 of the electrical contact 218 and the corresponding electrical wire 12 from dirt, dust, moisture, debris, and/or other contaminants. The housing 216 may include any number of slots 288 for exposing the wire interface(s) 248 of any number of electrical contacts 218.

FIG. 15 is a cross-sectional view of a portion of the electrical connector 210 illustrating the end 290 of the slot 288. In the exemplary embodiment, each electrical contact 218 includes two contact beams 226. The contact beams 226 include inner sides 238 that oppose each other. Each contact beam 226 includes an edge 244 that extends along the inner side 238. As shown in FIG. 15, the end 290 of the slot 288 exposes the wire interfaces 248 of the contact beams 226.

In the exemplary embodiment, the wire interface 248 of each contact beam 226 is at least partially defined by the edge 244. In some embodiments, the wire interface 248 includes one or more portions of the inner side 238 that is adjacent the edge 244. In addition or alternatively to the edge 244 and/or one or more portions of the inner side 238 that is adjacent the edge 244, any other location(s) along the contact beam 226 may define a portion or an entirety of the wire interface 248 of the contact beam 226. Each of the contact beams 226 may be referred to herein as a "first" and/or a "second" contact beam. The wire interface 248 of each of the contact beams 226 may be referred to herein as a "first" and/or a "second" wire interface.

Each contact beam 226 is moveable along an arc J between an open position and one or more closed positions. In the exemplary embodiment, each contact beam 226 is moveable between the open position, a partially closed position (not shown), and a fully closed position. FIG. 15 illustrates the fully closed positions of the contact beams 226, while FIG. 16 illustrates the open positions of the contact beams 226. In the open position, the wire interface 248 of the contact beam 226 is configured to be disengaged from the corresponding electrical wire 12. In the partially closed position, the wire interface 248 of each contact beam 226 is configured to be engaged with the corresponding electrical wire 12. In the exemplary embodiment, each contact beam 226 includes the fully closed position wherein the corresponding electrical wire 12 is not present. Optionally, one or more of the contact beams 226 is a spring that is resiliently deflectable from the fully closed position to the open position. In such embodiments, wherein a contact beam 226 is a spring, the contact beam 226 is resiliently deflectable from the fully closed position to the partially closed position, and from the partially closed position to the open position.

The actuator 230 includes an end 262. The actuator 230 is configured to be movably received within the slot 288 of the housing 216 such that the end 262 is configured to move within the slot 288 along the length of the slot 288. As the end 262 of the actuator 230 moves along the length of the slot 288, the end 262 is configured to slidably engage the contact beams 226 of the electrical contact 218 to move the contact beams 226 from the fully closed position to the open position and thereby enable the corresponding electrical wire 12 to be installed to the electrical contact 218. Moreover, the end 262 of the actuator 230 is also configured to slidably engage the contact beams 226 of the electrical contact 218 to move the contact beams 226 from the partially closed position to the open position and thereby enable the corresponding electrical wire 12 to be removed, or uninstalled, from the electrical contact 218.

Movement of the actuator 230 within the slot 288 to move the contact beams 226 is along an actuation direction J. Specifically, movement of the actuator 230 within the slot 288 along the actuation direction J causes the end 290 of the actuator 230 to slidably engage the contact beams 226 and thereby move the contact beams 226. Referring again to FIG. 14, in the exemplary embodiment, the actuation direction J is oblique to the insertion axis 224 (FIG. 14). But, the actuation direction J may be any direction that is non-perpendicular to the insertion axis 224. For example, in some embodiments, the actuation direction J is approximately parallel to the insertion axis 124.

In the exemplary embodiment, the actuator 230 is a wire, such as, but not limited to, an electrical wire, an optical wire, a non-electrically conductive wire, a non-optically conductive wire, a wire specifically designed as the actuator 230, a wire having a similar size and/or shape to any of the exemplary wires described and/or illustrated herein, and/or the like. But, the actuator 230 is not limited to being a wire. Rather, the actuator 230 may have any structure that enables the actuator 230 to slidably engage a contact beam 226 (FIGS. 15 and 16) and thereby move the contact beam 226, such as, but not limited to, a paper clip, a rod, and/or the like. The size and/or shape of the actuator 230 may be selected to complement the size and/or shape of the slot 288, and/or vice versa.

Referring again to FIG. 15, the actuator 230 can be moved within the slot 288 in the actuation direction J to move the contact beams 226 from the fully closed positions shown in FIG. 15 to the open positions shown in FIG. 16. As the actuator 230 is moved in the actuation direction J, the end 262 of the actuator 230 slidably engages the inner sides 238 of the contact beams 226. The slidable engagement between the end 262 and the contact beams 226 moves the contact beams 226 from the fully closed positions to the open positions.

FIG. 16 is a cross-sectional view of a portion of the electrical connector 210 illustrating the actuator 230 engaged with the contact beams 226 such that the contact beams 226 are in the open positions. The end 262 of the actuator 230 may or may not engage the edge 244 and/or the wire interface 248 of each of the contact beams 226 to move the contact beams 226 to the open positions. In the exemplary embodiment, the end 262 of the actuator 230 slidably engages both the edge 244 and the wire interface 248 of each of the contact beams 226 to move the contact beams 226 to the open positions.

In the open positions shown in FIG. 16, the contact beams 226 of the electrical contact 218 are positioned such that an electrical wire 12 can be installed to the electrical contact 218. Specifically, the corresponding electrical wire 12 can be inserted, or poked, into the corresponding receptacle 220 (FIG. 14) along the insertion axis 224 (FIG. 14). As the electrical wire 12 is poked into the receptacle 220, the electrical wire 212 is received between the wire interfaces 248 of the contact beams 226 and between the end 262 of the actuator 230 and a base (not shown) of the electrical contact 218. The contact beams 226 can then be moved from the open positions to the partially closed positions such that the wire interfaces 248 engage the electrical wire 12 and thereby establish an electrical connection between the electrical contact 218 and the electrical wire 12. To move the contact beams 226 from the open positions to the partially closed positions, the actuator 230 is moved along an unactuation direction K.

In some alternative embodiments, the actuator 230 is not used to install the electrical wire 12 to the electrical contact 218. For example, the insertion force exerted by the electrical wire 12 on the contact beams 226 may be sufficient to move the contact beams 226 from the fully closed position toward the open position a sufficient amount such that the electrical wire 12 can be captured between the wire interfaces 248 without using the actuator 230.

To uninstall the electrical wire 12 from the electrical contact 218, the end 262 of the actuator 230 can be moved within the slot 288 along the actuation direction J to the position shown in FIG. 16, wherein the contact beams 226 are in the open positions. In the open positions, the wire interfaces 248 of the contact beams 226 are disengaged from the electrical wire 12. The electrical wire 12 can then be pulled along the insertion axis 224 to remove the electrical wire 12 from the electrical contact 218 and from the corresponding housing receptacle 220.

Figure 17:
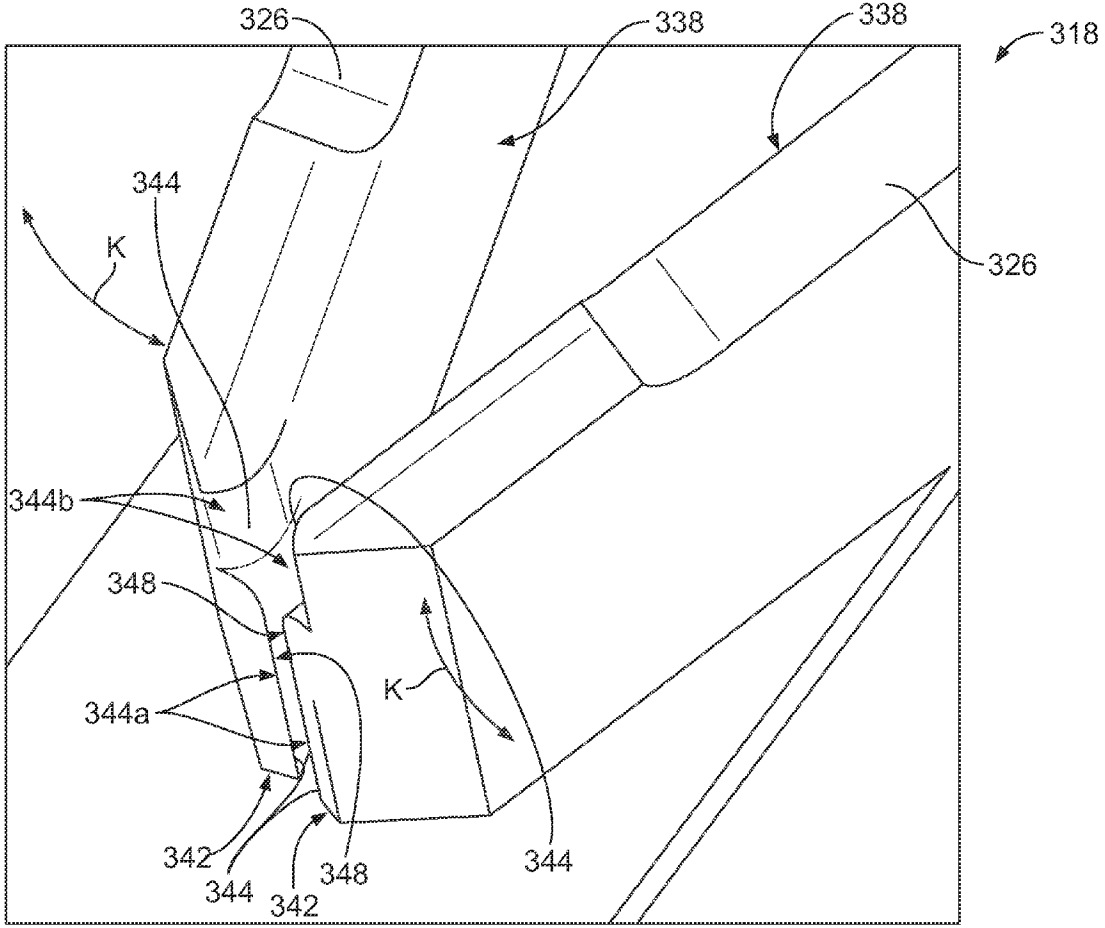
FIG. 17 is a perspective view of a portion of another exemplary embodiment of an electrical contact that may be used with the electrical connectors shown and/or described herein.

FIG. 17 is a perspective view of a portion of another exemplary embodiment of an electrical contact 318 that may be used with the electrical connectors described and/or illustrated herein (e.g., the electrical connector 10 shown in FIGS. 1, 5, and 6, the electrical connector 110 shown in FIG. 11, or the electrical connector 210 shown in FIGS. 14-16). In the exemplary embodiment, the electrical contact 318 includes two contact beams 326. The contact beams 326 include inner sides 338 that oppose each other. The contact beams 326 include end sides 342. The inner sides 338 intersect the ends sides 342 at edges 344.

Each contact beam 326 is moveable along an arc K between an open position and one or more closed positions. The contact beams 326 are shown in fully closed positions in FIG. 17. The contact beams 326 include wire interfaces 348 where the contact beams 326 are configured to engage a corresponding electrical wire 12 (FIGS. 1, 11, and 14) to thereby form an electrical connection between the electrical contact 318 and the corresponding electrical wire 12. In the exemplary embodiment, the wire interface 348 of each contact beam 326 is at least partially defined by the edge 344. In some embodiments, the wire interface 348 includes one or more portions of the inner side 338 that is adjacent the edge 344. Each of the contact beams 326 may be referred to herein as a "first" and/or a "second" contact beam. The wire interface 348 of each of the contact beams 126 may be referred to herein as a "first" and/or a "second" wire interface.

The edge 344 of each contact beam 326 includes a wire segment 344*a* and an actuator segment 344*b*. The wire segment 344*a* is configured to engage the corresponding electrical wire 12 to form the electrical connection between electrical contact 318 and the corresponding electrical wire 12. The wire segment 344*a* of the edge 344 may define a relatively sharp corner to facilitate gripping the corresponding electrical wire 12 and thereby forming a secure mechanical and electrical connection to the corresponding electrical wire 12.

The actuator segment 344*b* of the edge 344 of each contact beam 326 is configured to be slidably engaged by an actuator (e.g., the actuator 30 shown in FIGS. 1 and 4-10, the actuator 130 shown in FIGS. 11 and 13, or the actuator 230 shown in FIGS. 14-16) to move the contact beam 326 from a closed position to an open position. The actuator segment 344*b* of the edge 344 may define a radial chamfer to facilitate preventing the actuator segment 344*b* of the edge 344 from gripping the actuator as the actuator slidably engages the actuator segment 344*b* of the edge 344.

Figure 18:
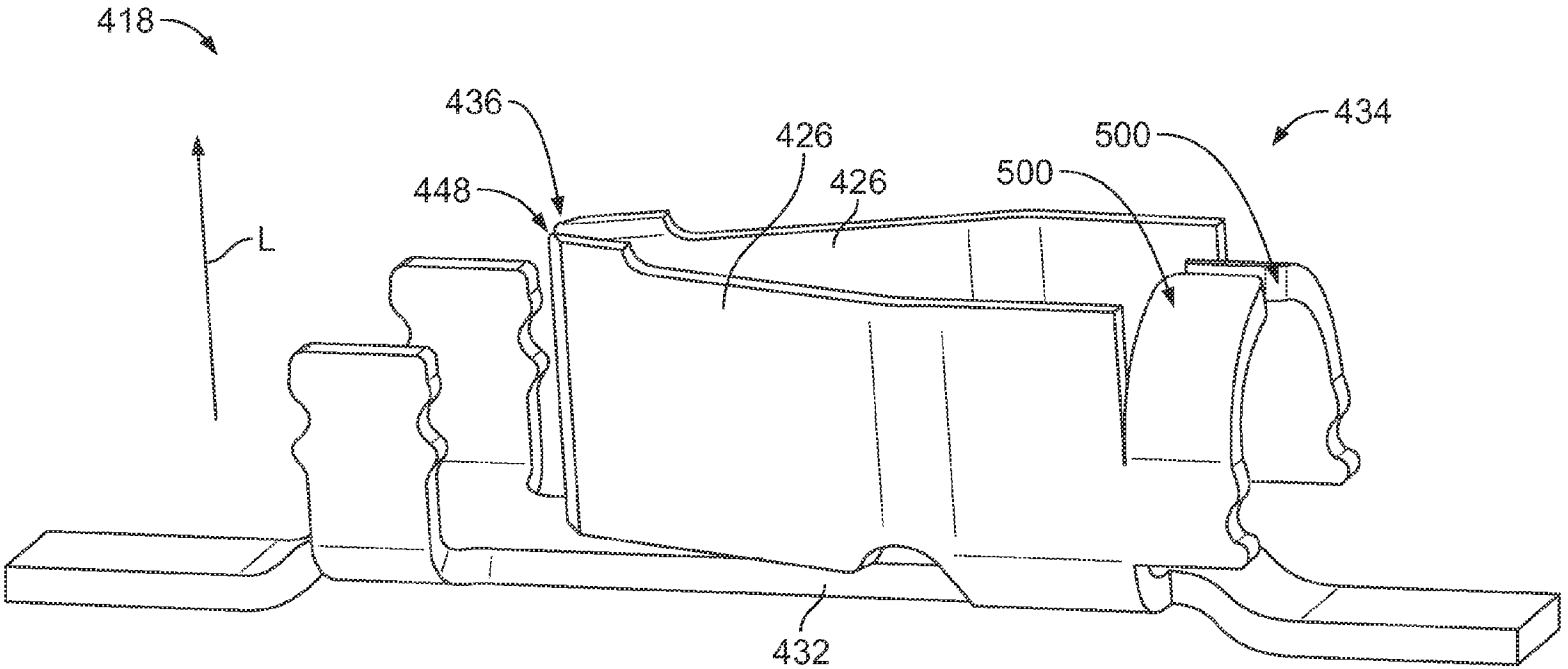
FIG. 18 is a perspective view of another exemplary embodiment of an electrical contact that may be used with the electrical connectors shown and/or described herein.

FIG. 18 is a perspective view of another exemplary embodiment of an electrical contact 418 that may be used with the electrical connectors described and/or illustrated herein (e.g., the electrical connector 10 shown in FIGS. 1, 5, and 6, the electrical connector 110 shown in FIG. 11, or the electrical connector 210 shown in FIGS. 14-16). The electrical contact 418 includes a base 432 and one or more contact beams 426 that extend from the base 432. Each contact beam 426 extends a length from an end 434 to an opposite end 436. In the exemplary embodiment, the electrical contact 418 includes two contact beams 426. Each of the contact beams 426 may be referred to herein as a "first" and/or a "second" contact beam.

The contact beams 426 include wire interfaces 448 where the contact beams 426 are configured to engage a corresponding electrical wire 12 (FIGS. 1, 11, and 14) to thereby form an electrical connection between the electrical contact 418 and the corresponding electrical wire 12. The electrical contact 418 includes one or more wire supports 500. The wire supports 500 are configured to engage the corresponding electrical wire 12 to facilitate preventing a housing (e.g., the housing 16 shown in FIGS. 1, 5, and 6, the housing 116 shown in FIG. 11, or the housing 216 shown in FIG. 14-16) of the electrical connector from being dislodged from the electrical contact 418 and/or to facilitate preventing the corresponding electrical wire 12 from being disengaged from the electrical contact 418. Specifically, when the electrical contact 418 is secured to a circuit board (e.g., the circuit board 14 shown in FIG. 1), if the corresponding electrical wire 12 is pulled upwardly in the direction of the arrow L, the corresponding electrical wire 12 may pull the housing off of the electrical contact 418 such that the electrical contact 418 is dislodged from the housing. Moreover, the force applied to the corresponding electrical wire 12 may pull the corresponding electrical wire 12 off of the electrical contact 418 such that the corresponding electrical wire 12 is disengaged from, and thereby not electrically connected to, the electrical contact 418. The wire supports 500 are configured to engage the corresponding electrical wire 12 to facilitate resisting movement of the corresponding electrical wire 12 in the direction of the arrow L. The wire supports 500 thereby facilitate preventing the housing and/or the corresponding electrical wire 12 from being dislodged and disengaged, respectively, from the electrical contact 418.

Although two are shown, the electrical contact 418 may include any number of the wire supports 500. In the exemplary embodiment, each wire support 500 extends from the ends 434 of the contact beams 426 of the electrical contact 418. But, each wire support 500 may have any other location along the electrical contact 418.

The embodiments described and/or illustrated herein may provide a poke-in wire contact having a wire interface that can be disengaged from an electrical wire. The embodiments described and/or illustrated herein may provide a poke-in wire contact that enables an electrical wire to be inserted into and removed from a receptacle multiple times without damaging the electrical wire and/or the poke-in wire contact.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a receptacle that is configured to receive an electrical wire therein along an insertion axis;

an electrical contact held by the housing, the electrical contact comprising first and second contact beams that include first and second wire interfaces, respectively, that are configured to engage the electrical wire, the first and second contact beams being movable between closed positions and open positions, the first and second wire interfaces being configured to engage the electrical wire when the first and second contact beams are in the closed positions, the first and second wire interfaces being configured to be disengaged from the electrical wire when the first and second contact beams are in the open positions, the first and second contact beams being configured to be engaged by an actuator that slides along the first and second beams in an actuation direction that is non-perpendicular to the insertion axis to move the first and second contact beams from the closed positions to the open positions, the first and second contact beams being configured to receive the actuator therebetween to spread the first and second contact beams apart when the actuator is moved in the actuation direction, wherein the receptacle is configured to receive the electrical wire therein along the insertion axis such that the electrical wire does not extend into the actuator during or after the actuator is inserted into the receptacle.

2. The electrical connector of claim 1, wherein the actuation direction is approximately parallel to the insertion axis.

3. The electrical connector of claim 1, wherein the first contact beam comprises a side that includes the first wire interface, the side of the first contact beam being configured to be engaged by the actuator to move the first contact beam from the closed position to the open position.

4. The electrical connector of claim 1, wherein the housing comprises a slot, the slot being configured to moveably receive the actuator therein such that the actuator moves along the length of the slot to move the first and second contact beams from the closed positions to the open positions.

5. The electrical connector of claim 1, wherein the first contact beam is configured to be engaged by the actuator at the first wire interface.

6. The electrical connector of claim 1, wherein the first contact beam comprises an edge, the first wire interface including the edge, the edge of the first contact beam being configured to be engaged by the actuator to move the first contact beam from the closed position to the open position.

7. The electrical connector of claim 1, wherein at least one of the first contact beam or the second contact beam is a spring that is resiliently deflectable from the closed position.

8. The electrical connector of claim 1, further comprising the actuator, wherein the actuator is moveably held by the housing such that the actuator is configured to move relative to the housing to move the first and second contact beams from the closed positions to the open positions.

9. The electrical connector of claim 1, further comprising the actuator, wherein the actuator comprising a wedge that is configured to slidably engage the first and second contact beams to move the first and second contact beams from the closed positions to the open positions.

10. The electrical connector of claim 1, further comprising the actuator, wherein the actuator comprises at least one of a card, a wire, or a paper clip.

11. An electrical connector comprising:

a housing having a receptacle that is configured to receive an electrical wire therein along an insertion axis;

an electrical contact held by the housing, the electrical contact comprising first and second contact beams that include first and second wire interfaces, respectively, that are configured to engage the electrical wire, the first and second contact beams being movable between closed positions and open positions, the first and second wire interfaces being configured to engage the electrical wire when the first and second contact beams are in the closed positions, the first and second wire interfaces being configured to be disengaged from the electrical wire when the first and second contact beams are in the open positions; and an actuator that is configured to slidably engage the first and second contact beams along an actuation direction that is non-perpendicular to the insertion axis to move the first and second contact beams from the closed positions to the open positions, the first and second contact beams being configured to receive the actuator therebetween to spread the first and second contact beams apart when the actuator is moved in the actuation direction, wherein the receptacle is configured to receive the electrical wire therein along the insertion axis such that the electrical wire does not extend into the actuator during or after the actuator is inserted into the receptacle.

12. The electrical connector of claim 11, wherein the actuator is moveably held by the housing such that the actuator is configured to move relative to the housing to move the first and second contact beams from the closed positions to the open positions.

13. The electrical connector of claim 11, wherein the actuator comprises a wedge that is configured to slidably engage the first and second contact beams to move the first and second contact beams from the closed positions to the open positions.

14. The electrical connector of claim 11, wherein the actuator comprises at least one of a card, a wire, or a paperclip.

15. The electrical connector of claim 11, wherein the actuation direction is at least one of approximately parallel or oblique to the insertion axis.

16. The electrical connector of claim 11, wherein the housing comprises a slot, the slot being configured to moveably receive the actuator therein such that the actuator moves along the length of the slot to move the first and second contact beams from the closed positions to the open positions.

17. The electrical connector of claim 11, wherein the first contact beam comprises a side that includes the first wire interface, the actuator being configured to slidably engage the side of the first contact beam to move the first contact beam from the closed position to the open position.

18. An electrical connector comprising:

a housing having a receptacle that is configured to receive an electrical wire therein along an insertion axis;

an electrical contact held by the housing, the electrical contact comprising a contact beam that includes a wire interface that is configured to engage the electrical wire, the contact beam comprising an edge, the contact beam being movable between a closed position and an open position, the wire interface being configured to engage the electrical wire when the contact beam is in the closed position, the wire interface being configured to be disengaged from the electrical wire when the contact beam is in the open position, wherein the contact beam is configured to be slidably engaged by an actuator that slides along the first and second beams in an actuation direction that is approximately parallel to the insertion axis to move the contact beam from the closed position to the open position, the edge of the contact beam comprising a wire interface and an inner side, the wire interface being configured to engage the electrical wire that does not extend into the actuator, the inner side being configured to be engaged by the actuator as the actuator slides along the edge.

* * * * *